US007143029B2

(12) United States Patent
Elshafei

(10) Patent No.: US 7,143,029 B2
(45) Date of Patent: Nov. 28, 2006

(54) APPARATUS AND METHOD FOR CHANGING THE PLAYBACK RATE OF RECORDED SPEECH

(75) Inventor: Moustafa Elshafei, Ottawa (CA)

(73) Assignee: Mitel Networks Corporation, Ottawa (CA)

( * ) Notice: Subject to any disclaimer, the term of this patent is extended or adjusted under 35 U.S.C. 154(b) by 25 days.

(21) Appl. No.: 10/939,301

(22) Filed: Sep. 9, 2004
(Under 37 CFR 1.47)

(65) Prior Publication Data

US 2005/0149329 A1 Jul. 7, 2005

Related U.S. Application Data

(63) Continuation of application No. 10/729,842, filed on Dec. 4, 2003, now abandoned.

(30) Foreign Application Priority Data

Dec. 4, 2002 (GB) ..... 0228245.7

(51) Int. Cl.
*G10L 21/00* (2006.01)

(52) U.S. Cl. ..... 704/211; 704/500

(58) Field of Classification Search ..... 704/211, 704/500

See application file for complete search history.

(56) References Cited

U.S. PATENT DOCUMENTS 4,435,832 A * 3/1984 Asada et al. ..... 704/262
5,341,432 A 8/1994 Suzuki et al.
5,493,608 A 2/1996 O'Sullivan
5,828,994 A 10/1998 Covell et al.
6,009,386 A 12/1999 Cruickshank et al.
6,205,420 B1 3/2001 Takagi et al.
6,260,011 B1 * 7/2001 Heckerman et al. ..... 704/235
6,324,501 B1 11/2001 Stylianou et al.
6,490,553 B1 * 12/2002 Van Thong et al. ..... 704/211

FOREIGN PATENT DOCUMENTS

EP 0 817 168 A1 1/1998
EP 0 851 404 A2 7/1998
JP 2000-259200 9/2000
WO WO 02/13185 A1 2/2002

OTHER PUBLICATIONS

Search Report for corresponding GB patent application No. GB 0228245.7 dated Jul. 30, 2003.
Search Report for corresponding European patent application No. EP 03 25 7650 dated Jul. 5, 2004.

(Continued)

*Primary Examiner*—Daniel Abebe
(74) *Attorney, Agent, or Firm*—Beyer Weaver & Thomas, LLP

(57) ABSTRACT

An apparatus for changing the playback rate of recorded speech includes memory storing a plurality of recorded speech messages and a plurality of feature tables. Each feature table is associated with an individual one of the speech messages and includes speech frame parameters based on the jitter states of speech frames of the associated recorded speech message. A playback module receives input specifying a recorded speech message in the memory to be played and the rate at which the recorded speech message is to be played back. In response to the input, the playback module uses a set of decision rules to modify the specified speech message based on the speech frame parameters in the feature table associated with the specified speech message and the specified playback rate, prior to playing back the specified speech message.

26 Claims, 3 Drawing Sheets

OTHER PUBLICATIONS

Baba et al., "Development of a voice speed control system LSI," IEEE Trans. Consumer Electronics, vol. 41, issue 3, Aug. 1995, pp. 909-916.

Lee et al., "Variable Time-Scale Modification of Speech Using Transient Information," Acoustics, Speech and Signal Processing, 1997, pp. 1319-1322.

* cited by examiner

APPARATUS AND METHOD FOR CHANGING THE PLAYBACK RATE OF RECORDED SPEECH

CROSS REFERENCE TO RELATED APPLICATION

This application is a continuation application of U.S. patent application Ser. No. 10/729,842, filed Dec. 4, 2003, now abandoned entitled "APPARATUS AND METHOD FOR CHANGING THE PLAYBACK RATE OF RECORDED SPEECH" which is hereby incorporated by reference.

FIELD OF THE INVENTION

The present invention relates generally to interactive voice response (IVR) systems and in particular to an apparatus and method for changing the playback rate of recorded speech.

BACKGROUND OF THE INVENTION

Pre-recorded message prompts are widely used in IVR telecommunications applications. Message prompts of this nature provide users with instructions and navigation guidance using natural and rich speech. In many instances it is desired to change the rate at which recorded speech is played back. Playing back speech at different rates poses a challenging problem and many techniques have been considered.

One known technique involves playing recorded messages back at a clock rate that is faster than the clock rate used during recording of the messages. Unfortunately by doing this, the pitch of the played back messages is increased resulting in an undesirable decrease in intelligibility.

Another known technique involves dropping short segments from recorded messages at regular intervals. Unfortunately, this technique introduces distortion in the played back messages and thus, requires complicated methods to smooth adjacent speech segments in the messages to make the messages intelligible.

Time compression can also be used to increase the rate at which recorded speech is played back and many time compression techniques have been considered. One time compression technique involves removing pauses from recorded speech. When this is done, although the resulting played back speech is natural, many users find it exhausting to listen to because of the absence of pauses. It has been found that pauses are necessary for listeners to understand and keep pace with recorded messages.

U.S. Pat. No. 5,341,432 to Suzuki et al. discloses a popular time compression technique commonly referred to as the synchronized overlap add (SOLA) method. During this method, redundant information in recorded speech is detected and removed. Specifically, the beginning of a new speech segment is shifted over the end of the preceding speech segment to find the point of highest cross-correlation (i.e. maximum similarity). The overlapping speech segments are then averaged or smoothed together. Although this method produces good quality speech it is suitable only for use with clearly voiced parts of speech.

Other techniques for changing the playback rate of recorded speech have also been considered. For example, U.S. Pat. No. 6,205,420 to Takagi et al. discloses a method and device for instantly changing the speed of speech data allowing the speed of speech data to be adjusted to suit the user's listening capability. A block data splitter splits the input speech data into blocks having block lengths dependent on respective attributes. A connection data generator generates connection data that is used to connect adjacent blocks of speech data.

U.S. Pat. No. 6,009,386 to Cruikshank et al. discloses a method for changing the playback of speech using sub-band wavelet coding. Digitized speech is transformed into a wavelet coded audio signal. Periodic frames in the wavelet coded audio signal are identified and adjacent periodic frames are dropped.

U.S. Pat. No. 5,493,608 to O'Sullivan et al. discloses a system for adaptively selecting the speaking rate of a given message prompt based on the measured response time of a user. The system selects a message prompt of appropriate speaking rate from a plurality of pre-recorded message prompts that have been recorded at various speaking rates.

U.S. Pat. No. 5,828,994 to Covell et al. discloses a system for compressing speech wherein different portions of speech are classified into three broad categories. Specifically, different portions of speech are classified into pauses; unstressed syllables, words and phrases; and stressed syllables, words and phrases. When a speech signal is compressed, pauses are accelerated the most, unstressed sounds are compressed an intermediate amount and stressed sounds are compressed the least.

Although the above-identified prior art disclose techniques that allow the playback rate of recorded speech to be changed, improvements are desired. It is therefore an object of the present invention to provide a novel apparatus and method for changing the playback rate of recorded speech.

SUMMARY OF THE INVENTION

According to one aspect of the present invention there is provided an apparatus for changing the playback rate of recorded speech comprising: memory storing at least one recorded speech message; and a playback module receiving input specifying a recorded speech message in the memory to be played and the rate at which the specified speech message is to be played back, the playback module using a set of decision rules to modify the specified speech message to be played back based on features of the specified speech message and the specified playback rate prior to playing back the recorded speech message, the features being based on jitter states of the specified speech message.

According to another aspect of the present invention there is provided an apparatus for changing the playback rate of recorded speech comprising: memory storing a plurality of recorded speech messages and a plurality of feature tables, each feature table being associated with an individual one of the speech messages and including speech frame parameters based on the jitter states of speech frames of the associated speech message; and a playback module receiving input specifying a recorded speech message in the memory to be played and the rate at which the specified speech message is to be played back, the playback module using a set of decision rules to modify the specified speech message to be played back based on the speech frame parameters in the feature table associated with the specified speech message and the specified playback rate prior to playing back the recorded speech message.

In a preferred embodiment, the input specifying the playback rate is user selectable and the input specifying the recorded speech message is generated by an interactive voice response system. Preferably, the playback module includes a decision processor that generates speech modifying actions based on the speech frame parameters and the specified playback rate using decision rules from the set and a signal processor modifying the specified speech message to be played back in accordance with the speech modifying actions.

In a preferred embodiment, the speech frame parameters include apparent periodicity period $P_t$, frame energy $E_t$ and speech periodicity β. The decision processor classifies each of the speech frame parameters into decision regions and uses the classified speech frame parameters to determine the states of periodicity period jitter, the energy jitter and periodicity strength jitter. The speech modifying actions are based on the determined jitter states.

It is also preferred that the apparatus further includes a feature extraction module. The feature extraction module creates the feature tables based on the recorded speech messages. Specifically, during creation of each feature table, the feature extraction module divides the associated recorded speech message into speech frames, computes the apparent periodicity period, the frame energy and the speech periodicity for each speech frame and compares the computed apparent periodicity period, the frame energy and the speech periodicity with corresponding parameters of neighboring speech frames to yield the speech frame parameters.

According to yet another aspect of the present invention there is provided a method of changing the playback rate of a recorded speech message in response to a user selected playback rate command comprising the steps of: using a set of decision rules to modify the recorded speech message to be played back based on jitter states of the recorded speech message and the user selected playback rate command; and playing back the modified recorded speech message.

The present invention provides advantages in that the playback rate of recorded speech can be changed without significantly affecting the naturalness of the recorded speech. This is achieved by exploiting acoustic and prosodic clues of the recorded speech to be played back and using these clues to modify the recorded speech according to a set of perceptually derived decision rules based on the jitter states of speech frames.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Figure 1:
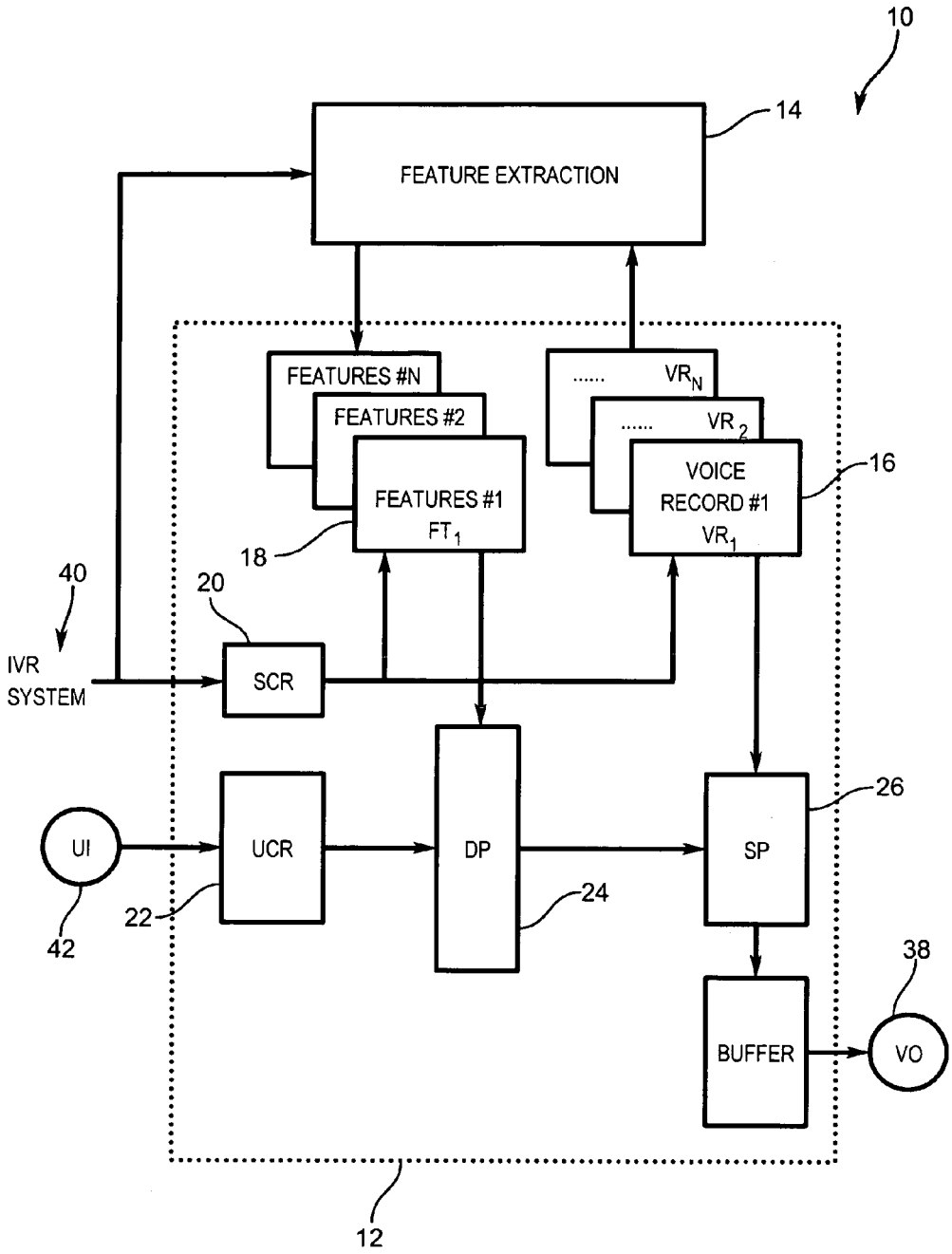
FIG. 1 is a schematic block diagram of an apparatus for changing the playback rate of recorded speech.

Turning now to FIG. 1, an apparatus for changing the playback rate of recorded speech is shown and generally identified by reference numeral 10. As can be seen, apparatus 10 includes a playback module 12, a feature extraction module 14, memory 16 storing a plurality of voice records $VR_1$ to $VR_N$ and memory 18 storing a plurality of feature tables $FT_1$ to $FT_N$. The voice records can be for example, voice prompts, voice-mail messages or any other recorded speech. Each feature table $FT_N$ is associated with a respective one of the voice records stored in memory 16.

The playback module 12 includes a system command register (SCR) 20, a user command register (UCR) 22, a decision processor (DP) 24, a signal processor (SP) 26 and a buffer 28. The buffer 28 provides output to a voice output device 38 that plays back recorded speech. The system command register 20 receives input commands from an interactive voice response (IVR) system 40 to play specified voice records. The user command register 22 receives input user commands (UI) 42 to adjust the playback rate of voice records $VR_N$ to be played back.

The feature extraction module 14 is responsive to input commands from the IVR system 40 and creates the feature tables $FT_1$ to $FT_N$ based on the associated voice records $VR_1$ to $VR_N$. In particular, for each voice record $VR_N$, the feature extraction module 14 divides the voice record into speech frames of fixed length FL. Each speech frame is analyzed independently and a plurality of extracted speech frame parameters are computed, namely the apparent periodicity period $P_t$, the frame energy $E_t$ and the speech periodicity β. A final set of speech frame parameters, based on the jitter states of the speech frames, is then determined by comparing the extracted speech frame parameters with corresponding speech frame parameters of neighboring speech frames and of the entire voice record. The final set of speech frame parameters includes periodicity period jitter, energy jitter and periodicity strength jitter parameters. The final set of speech frame parameters is stored in the feature table $FT_N$ and is used during playback of the associated voice record $VR_N$ as will be described.

During computation of the extracted speech frame parameters for each speech frame, the feature extraction module 14 stores the speech frame and previous speech samples in a buffer designed to hold approximately 25 m sec of speech. The speech is then passed through a low pass filter defined by the function:

$$H(z)=(1+z^{-1})/2 \quad (1).$$

The feature extraction module 14 defines the following function:

$$s(t,k)=\sum_{j=1}^{j=N1}\mathrm{abs}(s(t-j)-s(st-j-k)) \quad (2)$$

where s(t) is a sample of original speech at time t, k is a constant and N1 is equal to FL/2.

The apparent periodicity period $P_t$ is defined by the function:

$$P_t=\arg(\min(W(k)*s(t,k)) \text{ for } k \text{ from } k\min \text{ to } k\max \quad (3).$$

The selected values of the constants kmin and kmax depend on the sampling rate, the gender of the speaker, and whether information on the speaker voice characteristics are known beforehand. To reduce the possibility of misclassification, the computation is performed first on three or four voice records, and statistics about the speaker are then collected. Next a reduced range for kmax and kmin is calculated and used. In this embodiment, the selected range for a male prompt is taken to be between 40 and 120 samples. The weighting function W(k) penalizes selection of harmonics as the periodicity period.

The frame energy $E_t$ is computed using the formula:

$$E_t = \sum_{j=1}^{j=N1} s^2(t-j+1). \tag{4}$$

The speech periodicity β is computed using methods well-known to those skilled in the art, such as for example by auto-correlation analysis of successive speech frame samples.

The generation of the feature tables $FT_N$ can be performed off-line after the voice records $VR_N$ have been compiled or alternatively whenever a new voice record $VR_N$ is received.

When an input command is received by the system command register 20 from the IVR system 40 to play a specified voice record $VR_N$, the specified voice record $VR_N$ is retrieved from the memory 16 and conveyed to the signal processor 26. The feature table $FT_N$ associated with the specified voice record $VR_N$ is also determined and the final set of speech frame parameters in the feature table $FT_N$ is conveyed to the decision processor 24. The decision processor 24 also receives input user commands, signifying the user's selected playback rate for the specified voice record $VR_N$, from the user command register 22. In this particular embodiment, the user is permitted to select one of seven playback rates for the specified voice record $VR_N$. The playback rates include slow1, slow2, slow3, normal, fast1, fast2 and fast3.

In response to the speech frame parameters and the user selected playback rate, the decision processor 24 uses a set of perceptually driven decision rules to determine how the specified voice record $VR_N$ is to be played back. Each user selectable playback rate fires a different set of decision rules, which is used to test the condition state of the speech frames according to a set of decision regions. When a given speech frame satisfies the conditions set forth in a set of decision regions, the decision processor 24 generates appropriate modification commands or actions and conveys the modification commands to the signal processor 26. The signal processor 26 in turn modifies the specified voice record $VR_N$ in accordance with the modification commands received from the decision processor 24. The modified voice record $VR_N$ is then accumulated in the buffer 28. When the signal processor 26 completes processing of the voice record $VR_N$, the signal processor 26 sends the modified voice record $VR_N$ from the buffer 28 to the voice output device 38 for playback at the rate specified by the user.

Figure 2:
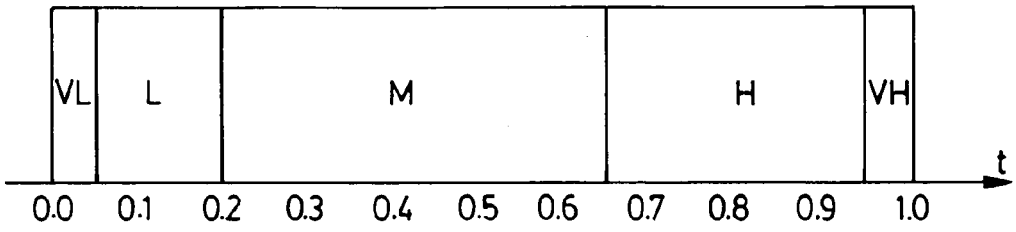
FIG. 2 shows decision levels for frame energy.
Figure 3:
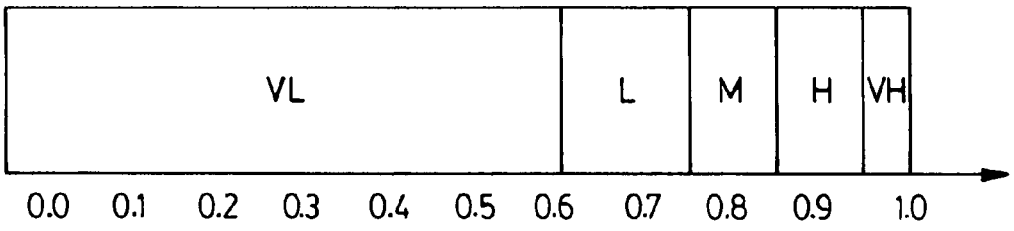
FIG. 3 shows decision levels for periodicity strength indicators.

During testing of the speech frame states, the range of each speech frame parameter or combination of speech frame parameters is divided into regions. The state of each speech frame parameter is then determined by the region(s) in which the value of the speech frame parameter falls. FIG. 2 illustrates the decision regions for the frame energy $E_t$. The decision regions are labeled very low (VL), low (L), middle or medium (M), high (H), and very high (VH). For example, if the frame energy is 0.78, the energy state (ES) of the speech frame is high H. The frame energy decision regions are based on statistics collected from all of the speech frames in the specified voice record. Similarly, FIG. 3 illustrates the decision regions for the speech periodicity β. The decision regions are non-uniform and are labeled VL, L, M, H, and VH. For example, the periodicity strength state (PSS) is low if the speech periodicity β of the speech frame is 0.65.

Figure 4:
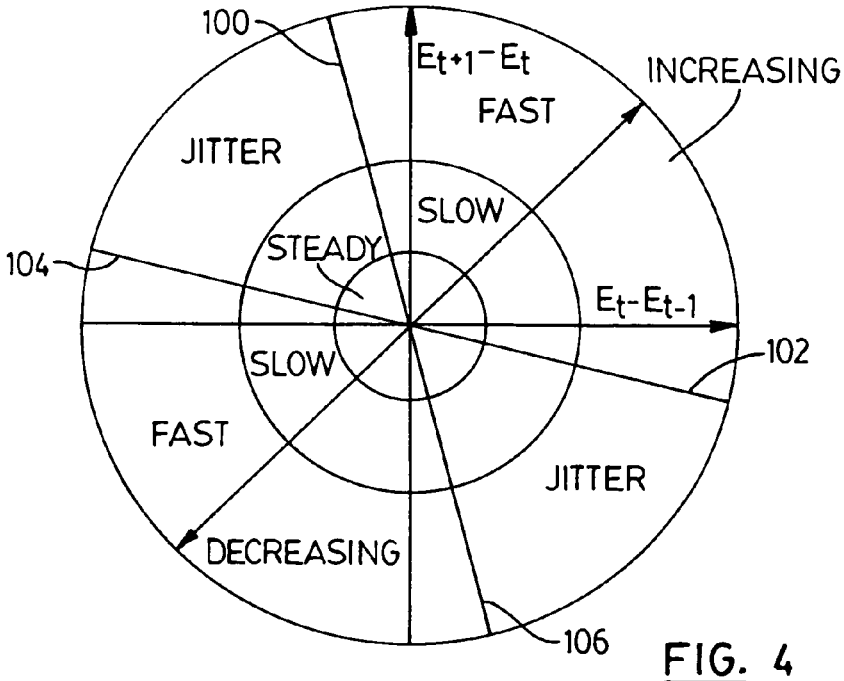
FIG. 4 shows decision regions for frame energy jitter states.

The decision regions for the speech frame energy jitter state (EJS) are illustrated in FIG. 4. The EJS is said to be increasing if the point $(E_t-E_{t-1}, E_{t+1}-E_t)$ falls inside the area bounded by lines 100 and 102. Within this area, further qualification of the EJS is defined as fast, slow, or steady. The other EJS decision regions in FIG. 4 are similarly shown and further qualified. For example, the EJS is said to be decreasing if the point $(E_t-E_{t-1}, E_{t+1}-E_t)$ falls inside the area bounded by lines 104 and 106.

Figure 5:
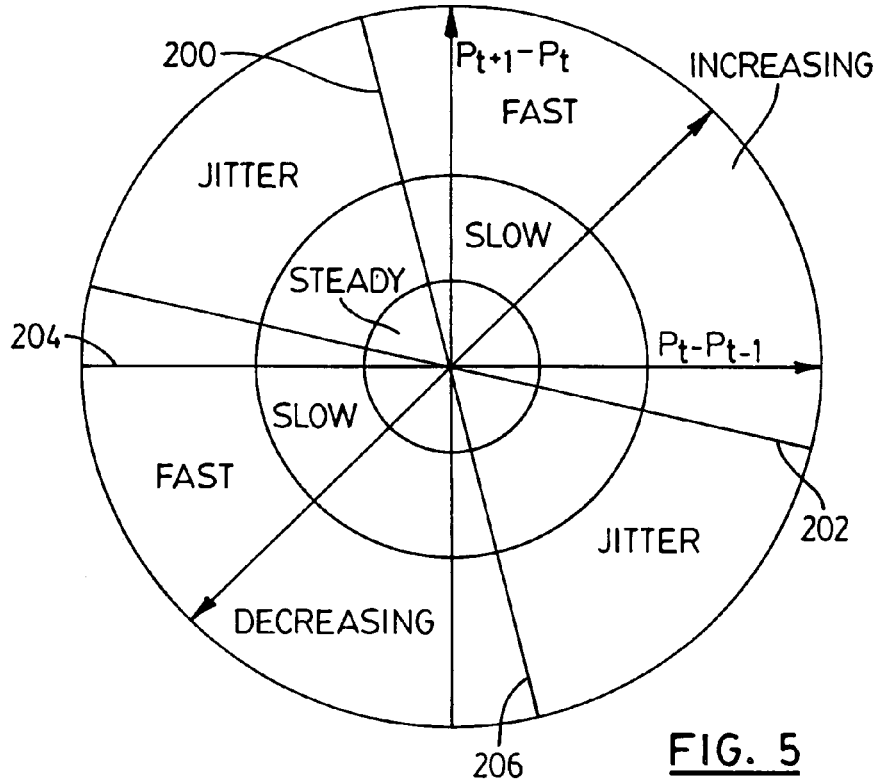
FIG. 5 shows decision regions for periodicity period jitter states.

FIG. 5 illustrates the decision regions for the periodicity period jitter state (PPJS). The PPJS is said to be increasing if the point $(P_t-P_{t-1}, P_{t+1}-P_t)$ falls inside the area bounded by lines 200 and 202. Within this area, further qualification of the PPJS is defined as fast, slow, or steady. The other PPJS decision regions in FIG. 5 are similarly shown and further qualified. For example, the PPJS is said to be decreasing if the point $(P_t-P_{t-1}, P_{t+1}-P_t)$ falls inside the area bounded by lines 204 and 206.

Figure 6:
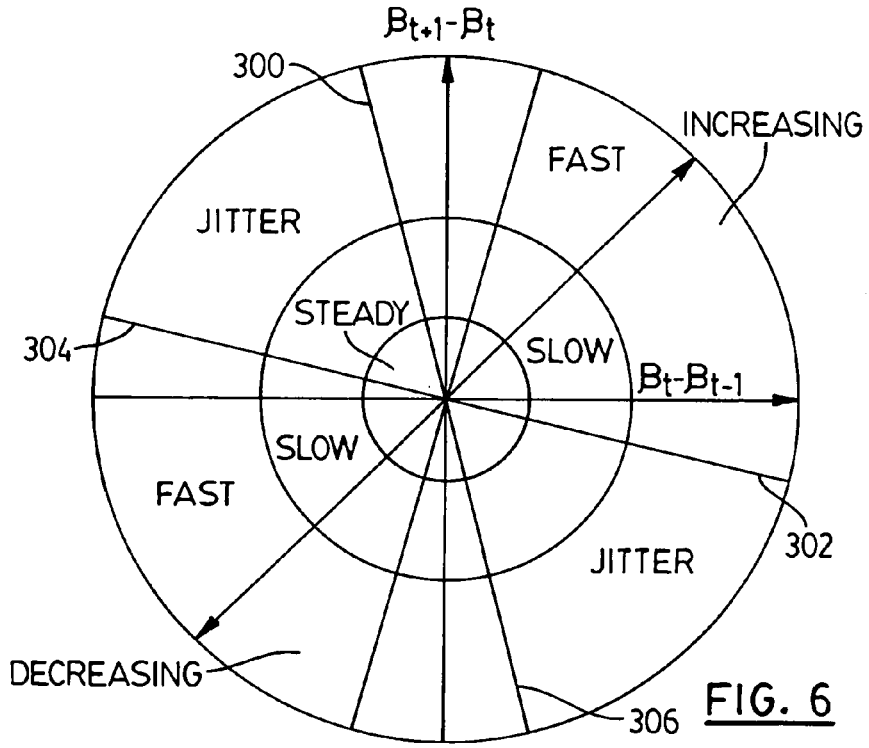
FIG. 6 shows decision regions for periodicity strength jitter states.

FIG. 6 illustrates the decision regions for the periodicity strength jitter state (PSJS). The PSJS is said to be increasing if the point $(\beta_t-\beta_{t-1}, \beta_{t+1}-\beta_t)$falls inside the area bounded by lines 300 and 302. Within this area, further qualification of the PSJS is defined as fast, slow, or steady. The other PSJS decision regions in FIG. 6 are similarly shown and further qualified. For example, the PSJS is said to be decreasing if the point $(\beta_t-\beta_{t-1}, \beta_{t+1}-\beta_t)$ falls inside the area bounded by lines 304 and 306.

With the states of the speech frame parameters known, the decision processor 24 uses the decision rules that are fired in response to the user selected playback rate to generate the appropriate modification commands. Each decision rule is comprised of a set of conditions and a corresponding set of actions. The conditions define when the decision rule is applicable. When a decision rule is deemed applicable, one or more actions contained by that decision rule may then be executed. These actions are associated with the states of the speech frame parameters either meeting or not meeting the set of conditions specified in the decision rule. The decision processor 24 tests these decision rules and implements them in one of in a variety of ways, such as for example simple if then else statements, neural networks or fuzzy logic.

The following notation describes a decision rule:

Rule_ID {Conditions} {Actions} {when constraint(s)}

Or if {Condition} Then {Actions} Else {Actions} When {Constraint

The identifier, rule-id, is a label used to refer to the decision rule.

Conditions specify the events that make the obligation active.

Constraint limits the applicability of a decision rule, e.g., to a particular time period, or making it valid after a particular date to limit the applicability of both authorization and obligation decision s based on time or values of the attributes of the speech frames.

Appendix A shows an exemplary set of decision rules used by the decision processor 24 to generate modification commands based on the user selected playback rate and the states of the speech frame parameters.

As will be appreciated by those of skill in the art, although a particular set of decision rules has been disclosed, other more refined decision rules can be included in the set that cover other cases of jitter states. For example, the set of decision rules may also include decision rules covering quasi-periodicity with slow or fast periodicity jitters, phoneme transitions, increasing/decreasing periodicity jitters as well as other jitter states.

The decision rules can be easily implemented using a neural network or fuzzy logic modeling. Other mathematical modeling techniques such as statistical dynamic modeling or cluster and pattern matching modeling can also be used.

Although a preferred embodiment of the present invention has been described, those of skill in the art will appreciate that variations and modifications may be made without departing from the spirit and scope thereof as defined by the appended claims.

Appendix A

Slow1

R-S1.1 Copy the Current Frame to the Buffer.

R-S 1.2

```
If { (PSI is VH) AND (E is H) AND (PJS is STEADY) AND
(EJS is STEADY) AND (PSJS is STEADY) }
Then {   1- Copy the last Pt samples.
Insert after the current frame }
```

Slow2

R-S2.1 Copy the Current Frame to the Buffer.

R-S2.2

```
If { (PSI is VH) AND (E is H) AND (PPJS is STEADY) AND
(EJS is STEADY) AND (PSJS is STEADY) }
Then {   1- Copy the last Pt samples.
Insert the two (Pt samples) after the current frame }
```

R-S2.3

```
If {   (PSI is H) AND (E is M) AND (PPJS is STEADY) }
Then {   1- Copy the last Pt samples
Scale its energy to be the normalized average of Et and Et+1
Insert after the current frame }
```

This action can only be performed once for each two consecutive frames of the original speech.

R-S2.4

```
If (PSI is VH) AND (E is H) AND (PPJS is INCREASING or
DECREASING) AND (EJS is STEADY) }
THEN { 1- Copy the last (Pt +Pt+1)/2 samples
Insert after the current frame }
```

This action can only be performed once for each 3 consecutive frames of the original speech.

Slow3

R-S3.1 to R-S3.3 are the Same as R-S2.1 to R-S2.3 Respectively.

R-S3.4

```
If { (PSI is VH or H) AND (E is H) AND (PPJS is INCREASING or
DECREASING) AND (EJS is STEADY) }
THEN { 1- Copy the last (Pt +Pt+1)/2 samples
Insert after the current frame }
```

This action can only be performed once for each 2 consecutive frames of the original speech.

R-S3.5

```
If { (PSI is VL ) AND (E is L) AND (PSJS is JITTER) AND
(EJS is STEADY) AND (PPJS is JITTER) }
Then {
Copy the last sub-frame.
Scale its energy to be the normalized average of Et and Et+1
Insert after the current frame }
```

R-S3.6

```
BIf { (PSI is VL ) AND (E is VL) AND (PSJS is JITTER) AND
(EJS is STEADY) AND (PPJS is JITTER) }
THEN (     1- Copy the last FL/2 samples.
           2- Scale its energy to be the normalized average of Et and
           Et+1.
           3- Insert after the current frame }
```

This action can only be performed up to 15 consecutive frames.

R-S3.7

```
If { (PSI is VH or H) AND (PPJS is STEADY) AND (EJS is
DECREASING) }
Then {     1- Copy the last Pt samples
           2- Scale its energy to be the normalized average of Et and
           Et+1.
3- Insert after the current frame }
```

This action can only be performed once every 3 consecutive frames of the original speech.

Fast1

R-F1.1

```
If { (PSI is VL ) AND (E is VH) AND (PSJS is JITTER) AND
(EJS is JITTER) AND (PPJS is JITTER) }
Then { Drop this frame }
```

R-F1.2

```
If { (PSI is VH ) AND (E is H) AND (PSJS is STEADY) AND
(EJS is STEADY) AND (PPJS is STEADY) }
Then { Drop the last Pt samples; reserve the rest of the frame }
```

This action can only be performed once every 4 consecutive frames of the original speech.

R-F1.3

```
If { (PSI is VH ) AND (E is M or L) AND (PSJS is STEADY) AND
(EJS is STEADY) AND (PPJS is STEADY) }
Then { Drop the last Pt samples; reserve the rest of the frame }
```

This action can only be performed once every 3 consecutive frames of the original speech.

R-F1.4

If { (PSI is VL ) AND (E is VL) AND (PSJS is JITTER) AND (EJS is STEADY) AND (PPJS is JITTER) }
Then { Drop the last sub-frame; reserve the rest of the frame }

This action can only be performed up to 20 consecutive frames. If the conditions stated in this rule still persist (after 20 consecutive frames), drop the entire frame.

R-F1.5

If { none of the above rules are applied} Then { Copy the frame unmodified to the output buffer }

Fast2

R.F2.1 Same as R-F1.1

R-F2.2

If { (PSI is VH or H) AND (E is H) AND (PSJS is STEADY) AND (EJS is STEADY) AND (PPJS is STEADY) }
Then { Drop the last $P_t$ samples; reserve the rest of the frame }

This action can only be performed once every 3 consecutive frames of the original speech.

R-F2.3

If { (PSI is VH or H) AND (E is M or L) AND (PSJS is STEADY) AND (EJS is STEADY) AND (PPJS is STEADY) }
Then { Drop the last $P_t$ samples; reserve the rest of the frame }

This action can only be performed once every 2 consecutive frames of the original speech.

R-F2.4

If { (PSI is VL ) AND (E is VL) AND (PSJS is JITTER) AND (EJS is STEADY) AND (PPJS is JITTER) }
Then { Drop the last FL/2 samples; reserve the rest of the frame }

This action can only be performed up to 20 consecutive frames. If the conditions stated in this rule still persist, drop the entire frame.

R-F2.5

If { (PSI is H or M) AND (E is M) AND (PSJS is JITTER) AND (EJS is STEADY) AND (PPJS is STEADY) }
Then { Drop the last $P_t$ samples; reserve the rest of the frame }

This action can only be performed once every 3 consecutive frames of the original speech.

R-F2.6

If { (PSI is VL ) AND (E is L) AND (PSJS is JITTER) AND (EJS is STEADY) AND (PPJS is JITTER) }
Then { Drop the last sub-frame; reserve the rest of the frame }

R-F2.7

If { (PSI is VH or H) AND (E is H or M) AND (EJS is STEADY) AND (PPJS is SLOW INCREASING OR SLOW DECREASING) }
Then ( 1- drop the last $(P_t + P_{t+1})/2$ samples; reserve the rest of the frame }

This action can only be performed once for each 3 consecutive frames of the original speech.

R-F2.8

If { none of the above rules is applied } Then { Copy the frame unmodified to the output buffer }

Fast3

R-F3.1 is the same as R-F2.1

R-F3.2 is the same as R-F2.2

R-F3.3

If { (PSI is VH or H) AND (E is M or L) AND (PSJS is STEADY) AND (EJS is STEADY) AND (PPJS is STEADY) }
Then { Drop the last $P_t$ samples; reserve the rest of the frame }

R-F3.4

If { (PSI is VL ) AND (E is VL) AND (PSJS is JITTER) AND (EJS is STEADY) AND (PPJS is JITTER) }
Then { Drop the last FL/2 samples; reserve the rest of the frame }

This action can only be performed up to 10 consecutive frames. If the conditions stated in this rule still persist, drop the entire frame.

R-F3.5

If { (PSI is H or M) AND (E is M) AND (PSJS is JITTER) AND (EJS is STEADY) AND (PPJS is STEADY) }
Then { Drop the last $P_t$ samples; reserve the rest of the frame }

This action can only be performed once every 2 consecutive frames of the original speech.

R-F3.6

If { (PSI is VL) AND (E is L) AND (PSJS is JITTER) AND (EJS is STEADY) AND (PPJS is JITTER) }
Then { Drop the last FL/2 samples; reserve the rest of the frame }

R-F3.7

If { (PSI is VH or H) AND (E is H or M) AND (EJS is STEADY) AND (PPJS is SLOW INCREASING OR SLOW DECREASING) }
Then { 1- drop the last { $P_t + P_{t+1}$ )/2 samples; reserve the rest of the frame }

This action can only be performed once for each 2 consecutive frames of the original speech

R-F3.8

If { (PSI is VH or H) AND (E is H or M) AND (PSJS is NOT JITTER) AND (EJS is SLOW-DECREASING) AND (PPJS is STEADY) }
Then { Drop the last $(P_t+P_{t-1})/2$ samples;
Reserve the rest of the frame.
Set the energy of the first subframe of $F_{t+1}$ to be $(E_{t+1} + E_t)/2$.
Smooth the boundary samples of the frames }

This action can only be performed once every 2 consecutive frames of the original speech.

R-f3.9

If { none of the above rules is applied } Then { Copy the frame unmodified to the output buffer }

What is claimed is:

1. An apparatus for changing the playback rate of recorded speech comprising:

memory storing at least one recorded speech message; and a playback module receiving input specifying a recorded speech message in said memory to be played and the rate at which said specified speech message is to be played back, said playback module using a set of decision rules to modify the specified speech message to be played back based on features of the specified speech message and the specified playback rate prior to playing back said recorded speech message, said features being based on jitter states of said specified speech message.

2. An apparatus according to claim 1 wherein the input specifying said playback rate is user selectable.

3. An apparatus according to claim 2 wherein the input specifying said recorded speech message is generated by an interactive voice response system.

4. An apparatus according to claim 2 wherein said playback module includes:

a decision processor generating speech modifying actions based on speech frame parameters of said specified speech message and said specified playback rate using decision rules from said set; and a signal processor modifying said specified speech message in accordance with said speech modifying actions.

5. An apparatus according to claim 4 wherein said speech frame parameters include apparent periodicity period $P_t$, frame energy $E_t$ and speech periodicity $\beta$.

6. An apparatus according to claim 5 wherein said decision processor classifies each of said speech frame parameters into decision regions and uses the classified speech frame parameters to determine the states of periodicity period jitter, the energy jitter and periodicity strength jitter, said speech modifying actions being based on said determined jitter states.

7. An apparatus according to claim 1 wherein said playback module includes:

a decision processor generating speech modifying actions based on speech frame parameters of said specified speech message and said specified playback rate using decision rules from said set; and a signal processor modifying said specified speech message in accordance with said speech modifying actions.

8. An apparatus according to claim 7 wherein said speech frame parameters include apparent periodicity period $P_t$, frame energy $E_t$ and speech periodicity $\beta$.

9. An apparatus according to claim 8 wherein said decision processor classifies each of said speech frame parameters into decision regions and uses the classified speech frame parameters to determine the states of periodicity period jitter, the energy jitter and periodicity strength jitter, said speech modifying actions being based on said determined jitter states.

10. An apparatus according to claim 9 wherein said decision regions are fuzzy regions, the determined states being identified by said decision processor using fuzzy logic and the speech modifying actions being generated by said decision processor using fuzzy rules.

11. An apparatus according to claim 9 wherein said decision regions are divided using a neural network having input neurons and output neurons and wherein said speech frame parameters are connected to input neurons of said neural network, said speech modifying actions being determined by the output neurons of said neural network.

12. An apparatus for changing the playback rate of recorded speech comprising:

memory storing a plurality of recorded speech messages and a plurality of feature tables, each feature table being associated with an individual one of said speech messages and including speech frame parameters based on the jitter states of speech frames of said associated speech message; and a playback module receiving input specifying a recorded speech message in said memory to be played and the rate at which said recorded speech message is to be played back, said playback module using a set of decision rules to modify the specified speech message to be played back based on the speech frame parameters in the feature table associated with the specified speech message and the specified playback rate prior to playing back said specified speech message.

13. An apparatus according to claim 12 wherein the input specifying said playback rate is user selectable.

14. An apparatus according to claim 13 wherein the input specifying said recorded speech message is generated by an interactive voice response system.

15. An apparatus according to claim 13 wherein said playback module includes:

a decision processor generating speech modifying actions based on the speech frame parameters and said specified playback rate using decision rules from said set; and a signal processor modifying said specified speech message in accordance with said speech modifying actions.

16. An apparatus according to claim 15 wherein said speech frame parameters include apparent periodicity period $P_t$, frame energy $E_t$ and speech periodicity $\beta$.

17. An apparatus according to claim 16 wherein said decision processor classifies each of said speech frame parameters into decision regions and uses the classified speech frame parameters to determine the states of periodicity period jitter, the energy jitter and periodicity strength jitter, said speech modifying actions being based on said determined jitter states.

18. An apparatus according to claim 12 wherein said playback module includes:

a decision processor generating speech modifying actions based on the speech frame parameters and said specified playback rate using decision rules from said set; and a signal processor modifying said specified speech message in accordance with said speech modifying actions.

19. An apparatus according to claim 18 wherein said speech frame parameters include apparent periodicity period $P_t$, frame energy $E_t$ and speech periodicity $\beta$.

20. An apparatus according to claim 19 wherein said decision processor classifies each of said speech frame parameters into decision regions and uses the classified speech frame parameters to determine the states of periodicity period jitter, the energy jitter and periodicity strength jitter, said speech modifying actions being based on said determined jitter states.

21. An apparatus according to claim 20 wherein said apparatus further includes a feature extraction module, said feature extraction module creating said feature tables based on said recorded speech messages.

22. An apparatus according to claim 21 wherein said feature extraction module is responsive to an interactive voice response system.

23. An apparatus according to claim 22 wherein during creation of each feature table, said feature extraction module divides the associated recorded speech message into speech frames, computes the apparent periodicity period, the frame energy and the speech periodicity for each speech frame and compares the computed apparent periodicity period, the frame energy and the speech periodicity with corresponding parameters of neighbouring speech frames to yield said speech frame parameters.

24. An apparatus according to claim 12 wherein said apparatus further includes a feature extraction module, said feature extraction module creating said feature tables based on said recorded speech messages.

25. An apparatus according to claim 24 wherein said feature extraction module is responsive to an interactive voice response system.

26. A method of changing the playback rate of a recorded speech message in response to a user selected playback rate command comprising the steps of:

using a set of decision rules to modify the recorded speech message to be played back based on jitter states of the recorded speech message and the user selected playback rate command; and playing back the modified recorded speech message.

* * * * *